US005938049A

United States Patent [19]

Susholz

[11] Patent Number: 5,938,049

[45] Date of Patent: Aug. 17, 1999

[54] HOLDER FOR WET FOLD-UP AND LONG UMBRELLAS AND FOR DISPOSABLY COLLECTING WATER THEREFROM

[76] Inventor: Sinai Susholz, 812 Ditmas Ave., Brooklyn, N.Y. 11218

[21] Appl. No.: 09/161,634

[22] Filed: Sep. 28, 1998

[51] Int. Cl.[6] ..... A47F 7/00

[52] U.S. Cl. ..... 211/62; 312/229; 224/915

[58] Field of Search ..... 211/62, 63, 60.1; 312/206, 207, 229; 224/915

[56] References Cited

U.S. PATENT DOCUMENTS

| | | | |
|---|---|---|---|
| 1,661,098 | 2/1928 | Side | 211/62 |
| 2,028,337 | 1/1936 | Lane | 211/63 |
| 4,066,170 | 1/1978 | Huang | 211/63 |
| 4,700,847 | 10/1987 | Shieh | 211/62 |
| 4,807,920 | 2/1989 | Fujiki et al. | 211/63 X |
| 5,261,541 | 11/1993 | Li | 211/62 |
| 5,625,960 | 5/1997 | Fujita | 211/62 X |
| 5,676,290 | 10/1997 | Liu | 211/62 X |
| 5,709,328 | 1/1998 | Ackeret | 211/63 X |

*Primary Examiner*—Robert W. Gibson, Jr.

[57] ABSTRACT

A holder for wet fold-up umbrellas and wet long umbrellas and for disposably collecting water dripping therefrom. The holder includes a canister, an insert, and a drawer. The canister rests on a horizontal surface. The insert is replaceably mounted in the canister and suspends the wet fold-up umbrellas and the wet long umbrellas in the canister. The drawer is slidably and replaceably mounted in the canister and disposably collects the water dripping from the wet fold-up umbrellas and the wet long umbrellas.

13 Claims, 15 Drawing Sheets

HOLDER FOR WET FOLD-UP AND LONG UMBRELLAS AND FOR DISPOSABLY COLLECTING WATER THEREFROM

BACKGROUND OF THE INVENTION

1. Field of the Invention

The present invention relates to a holder for wet umbrellas. More particularly, the present invention relates to a holder for wet fold-up and long umbrellas and for disposably collecting water therefrom.

2. Description of the Prior Art

Numerous innovations for umbrella related devices have been provided in the prior art. Even though these innovations may be suitable for the specific individual purposes to which they address, however, they differ from the present invention.

Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a holder for wet fold-up and long umbrellas and for disposably collecting water therefrom that avoids the disadvantages of the prior art.

ANOTHER OBJECT of the present invention is to provide a holder for wet fold-up and long umbrellas and for disposably collecting water therefrom that is simple and inexpensive to manufacture.

STILL ANOTHER OBJECT of the present invention is to provide a holder for wet fold-up and long umbrellas and for disposably collecting water therefrom that is simple to use.

BRIEFLY STATED, YET ANOTHER OBJECT of the present invention is to provide a holder for wet fold-up umbrellas and wet long umbrellas and for disposably collecting water dripping therefrom. The holder includes a canister, an insert, and a drawer. The canister rests on a horizontal surface. The insert is replaceably mounted in the canister and suspends the wet fold-up umbrellas and the wet long umbrellas in the canister. The drawer is slidably and replaceably mounted in the canister and disposably collects the water dripping from the wet fold-up umbrellas and the wet long umbrellas.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
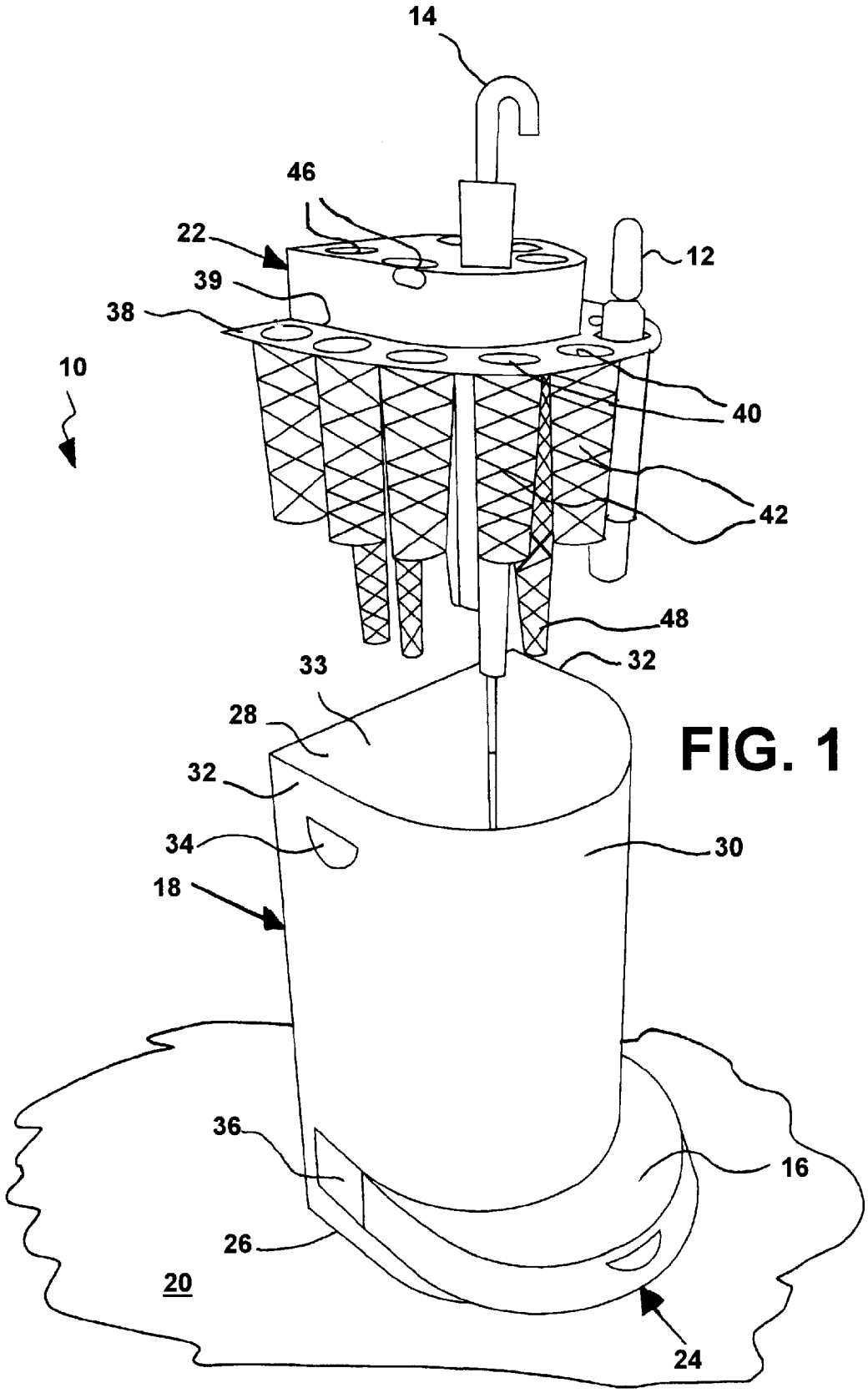
FIG. 1 is an exploded diagrammatic perspective view of the present invention holding a plurality of wet fold-up and long umbrellas and disposably collecting water therefrom.

10 holder for wet fold-up and long umbrellas and for disposably collecting water dripping therefrom of the present invention

12 wet fold-up umbrellas
14 wet long umbrellas
16 water
18 canister for resting on horizontal surface 20
20 horizontal surface
22 insert for suspending wet fold-up umbrellas 12 and wet long umbrellas 14 in canister 18
24 drawer for disposably collecting water 16 dripping from wet fold-up umbrellas 12 and wet long umbrellas 14
26 bottom of canister 18 for resting on horizontal surface 20
28 top of canister 18
30 front of canister 18
32 pair of sides of canister 18
33 interior of canister 18
34 recesses in each side of pair of sides 32 of canister 18
36 slot extending continuously in front 30 of canister 18 and pair of sides 32 of canister 18
38 plate of insert 22
39 inner perimeter of plate 38 of insert 22
40 plurality of throughbores in plate 38 of insert 22 for receiving the wet fold-up umbrellas 12
42 plurality of short mesh pockets of insert 22 for suspending wet fold-up umbrellas 12 in canister 18
44 extension of insert 22
46 plurality of throughbores in extension 44 of insert 22 for receiving wet long umbrellas 14
48 plurality of long mesh pockets of insert 22

DETAILED DESCRIPTION OF THE PREFERRED EMBODIMENT

Referring now to the figures, in which like numerals indicate like parts, and particularly to FIG. 1, which is an exploded diagrammatic perspective view of the present invention holding a plurality of wet umbrellas and disposably collecting water therefrom, the holder for wet fold-up and long umbrellas and for disposably collecting water dripping therefrom of the present invention is shown generally at 10 for wet fold-up umbrellas 12 and wet long umbrellas 14 and for disposably collecting water 16 dripping therefrom.

Figure 2A:
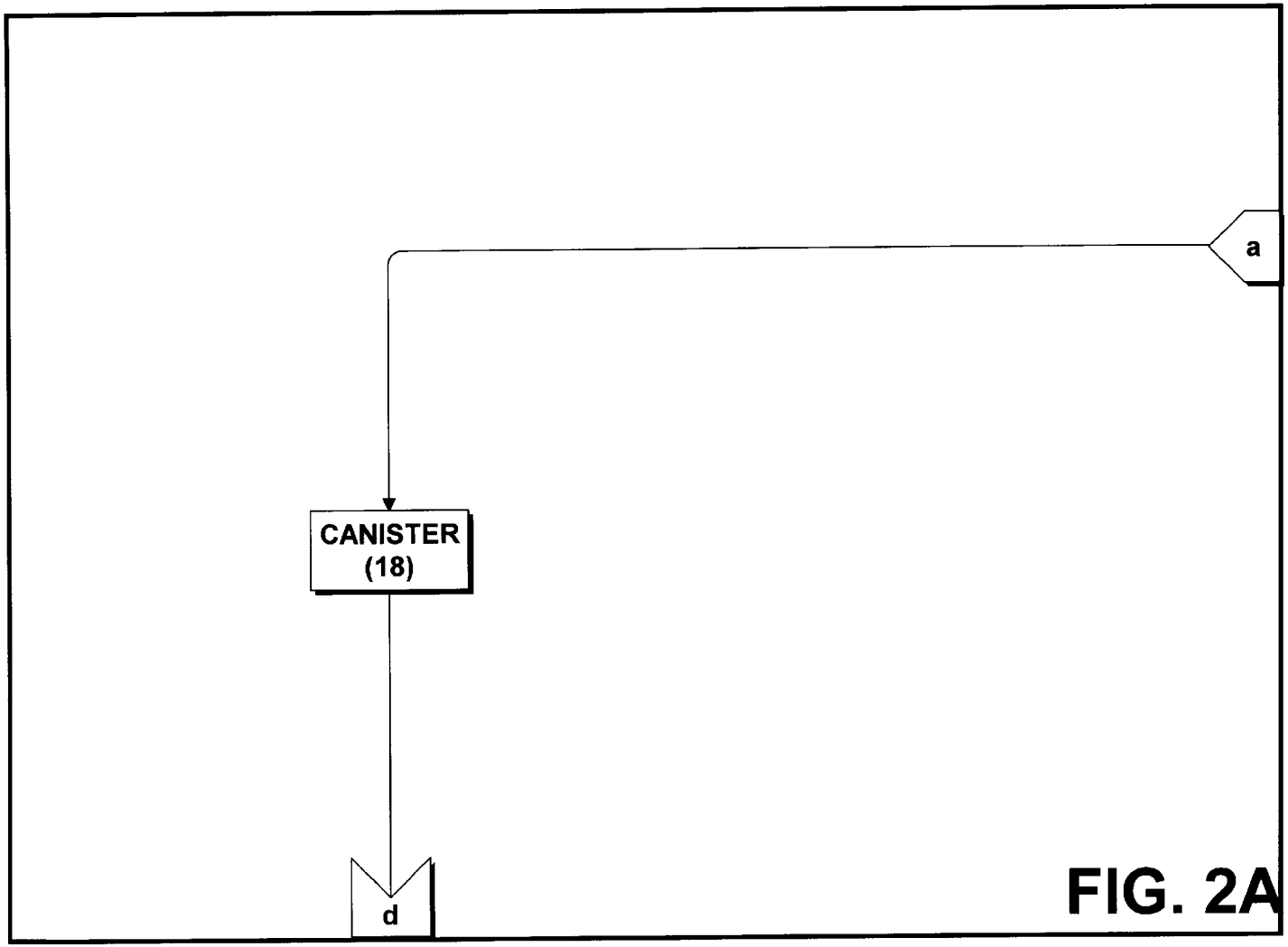
FIGS. 2A–2N are a system diagram of the present invention.
Figure 2B:
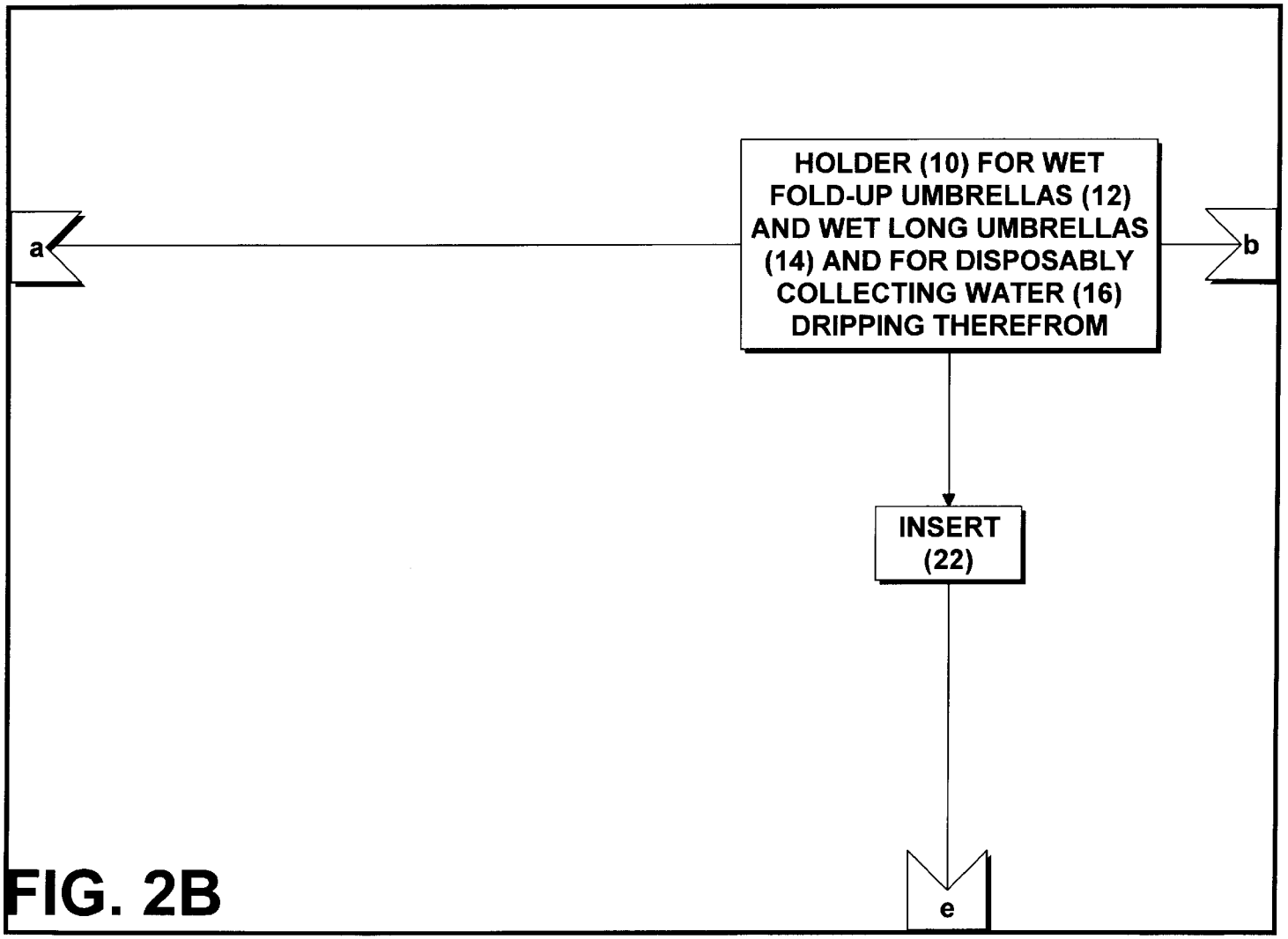
Figure 2C:
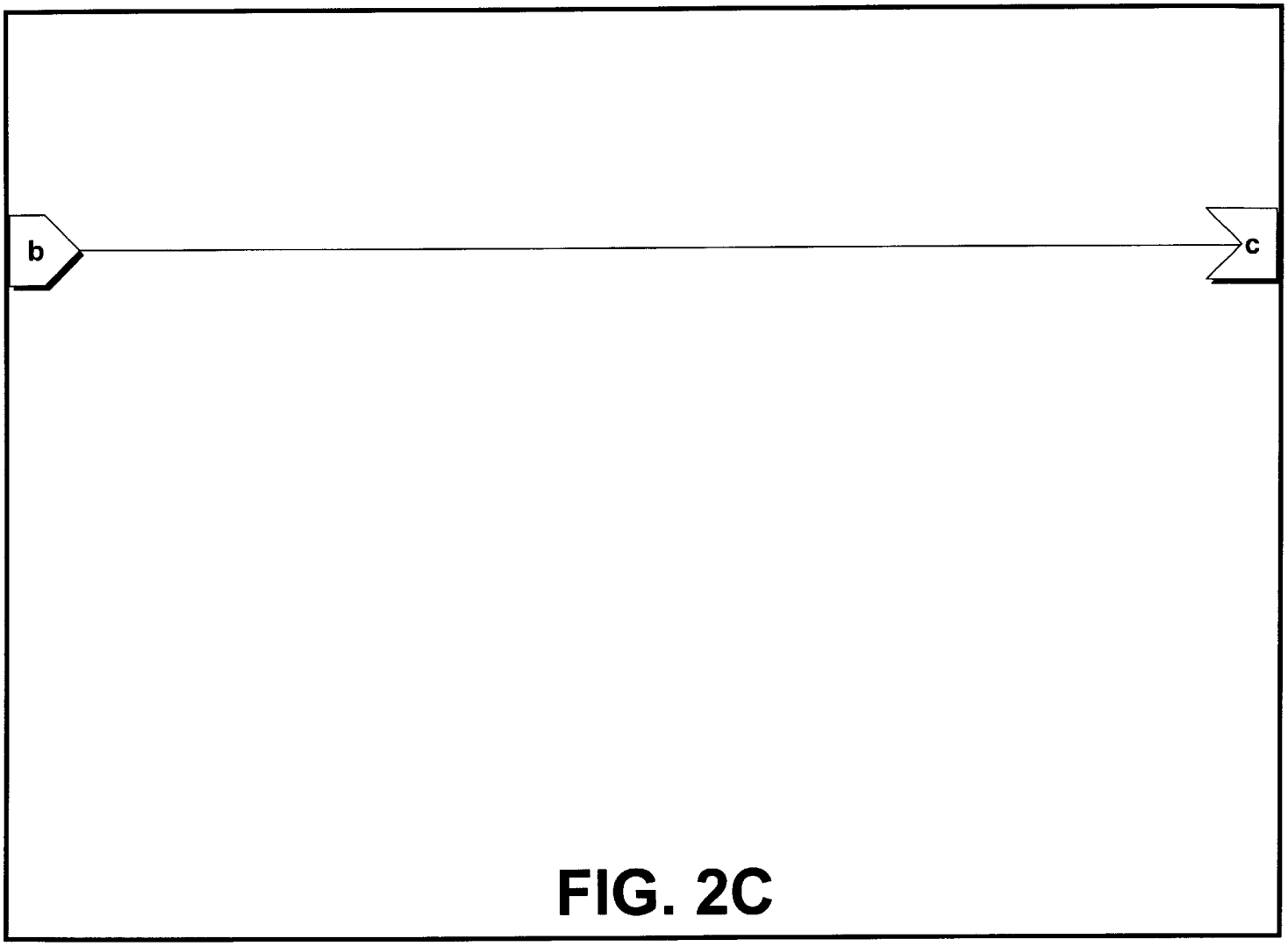
Figure 2D:
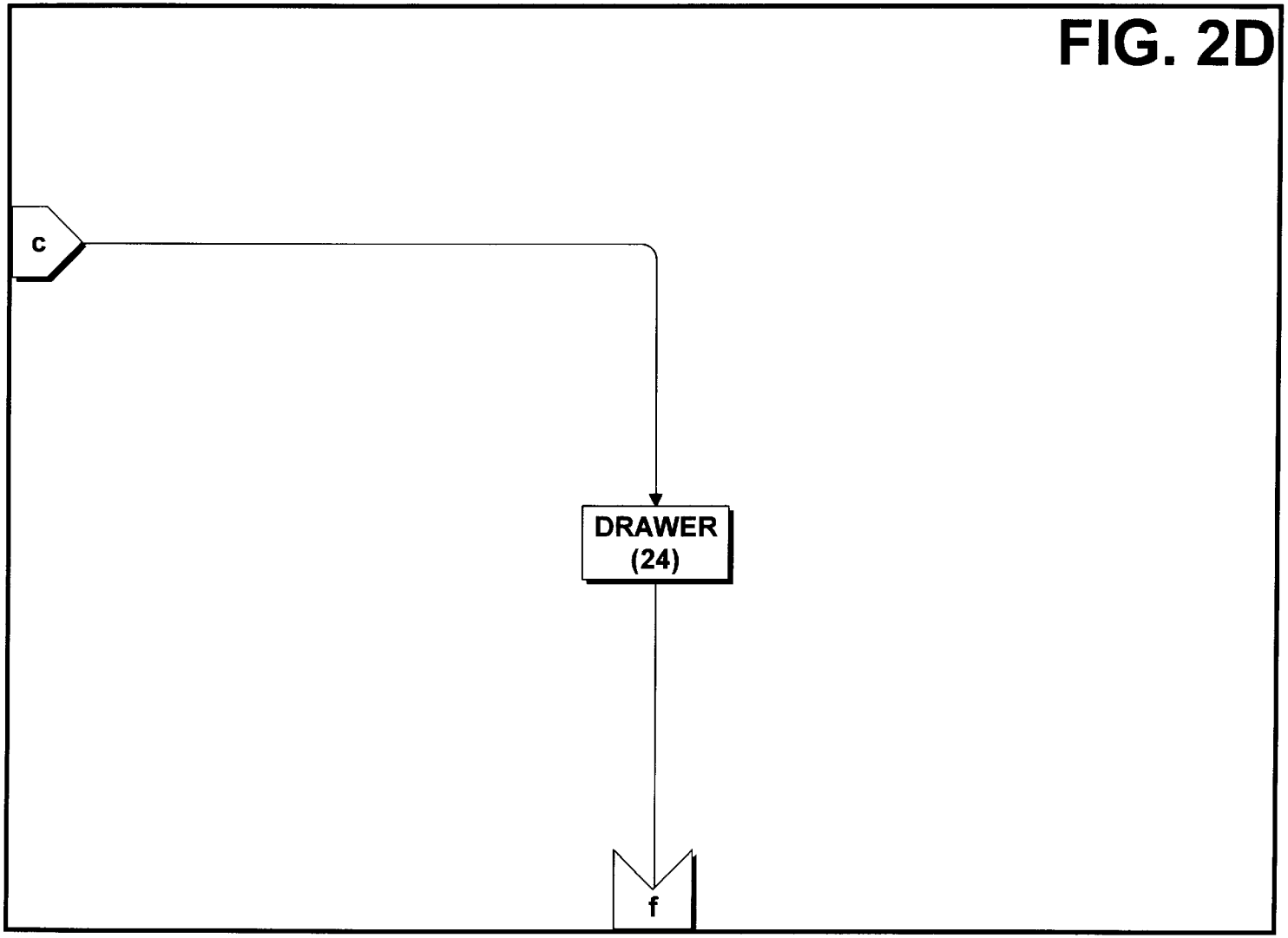
Figure 2E:
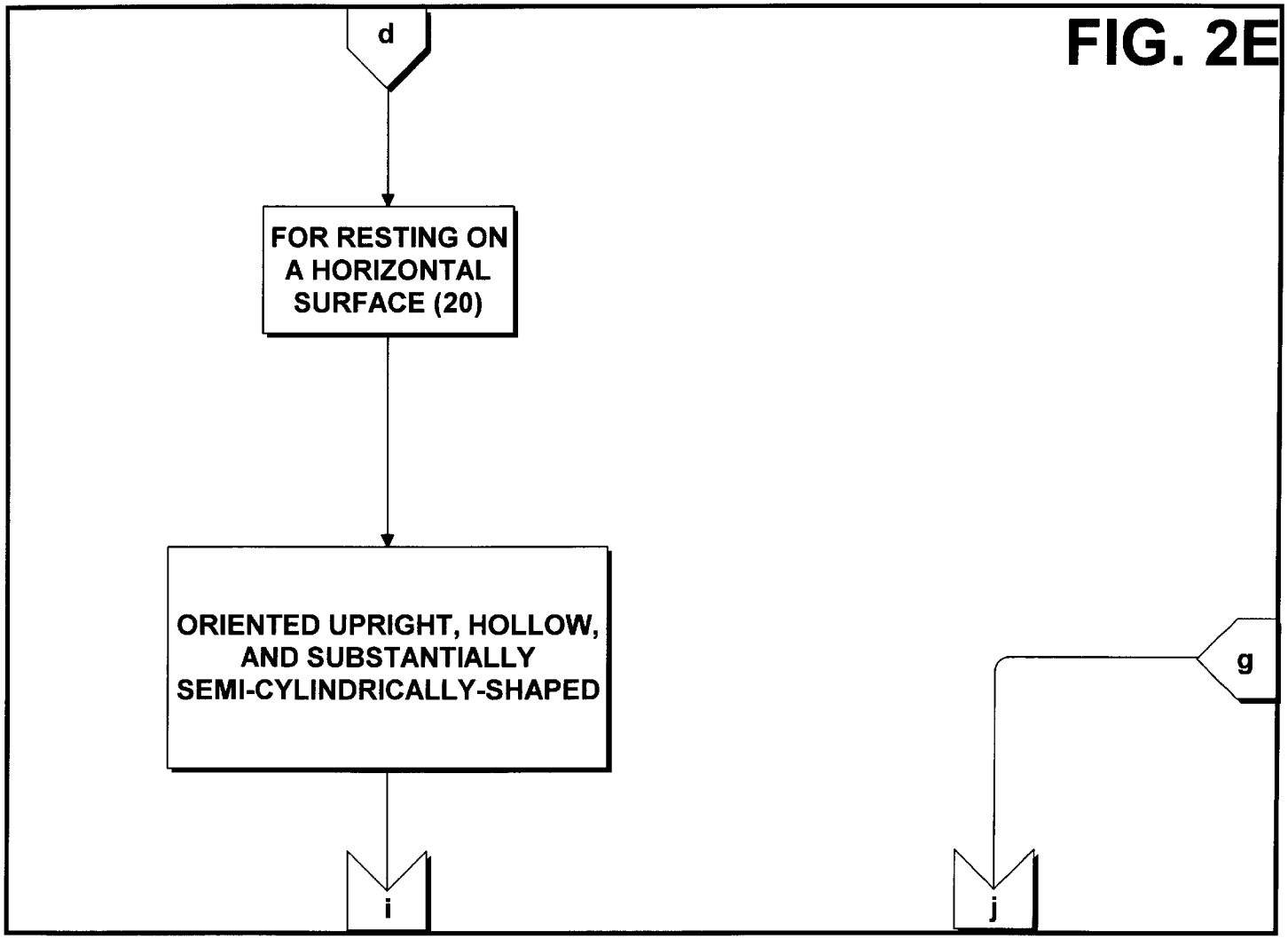
Figure 2F:
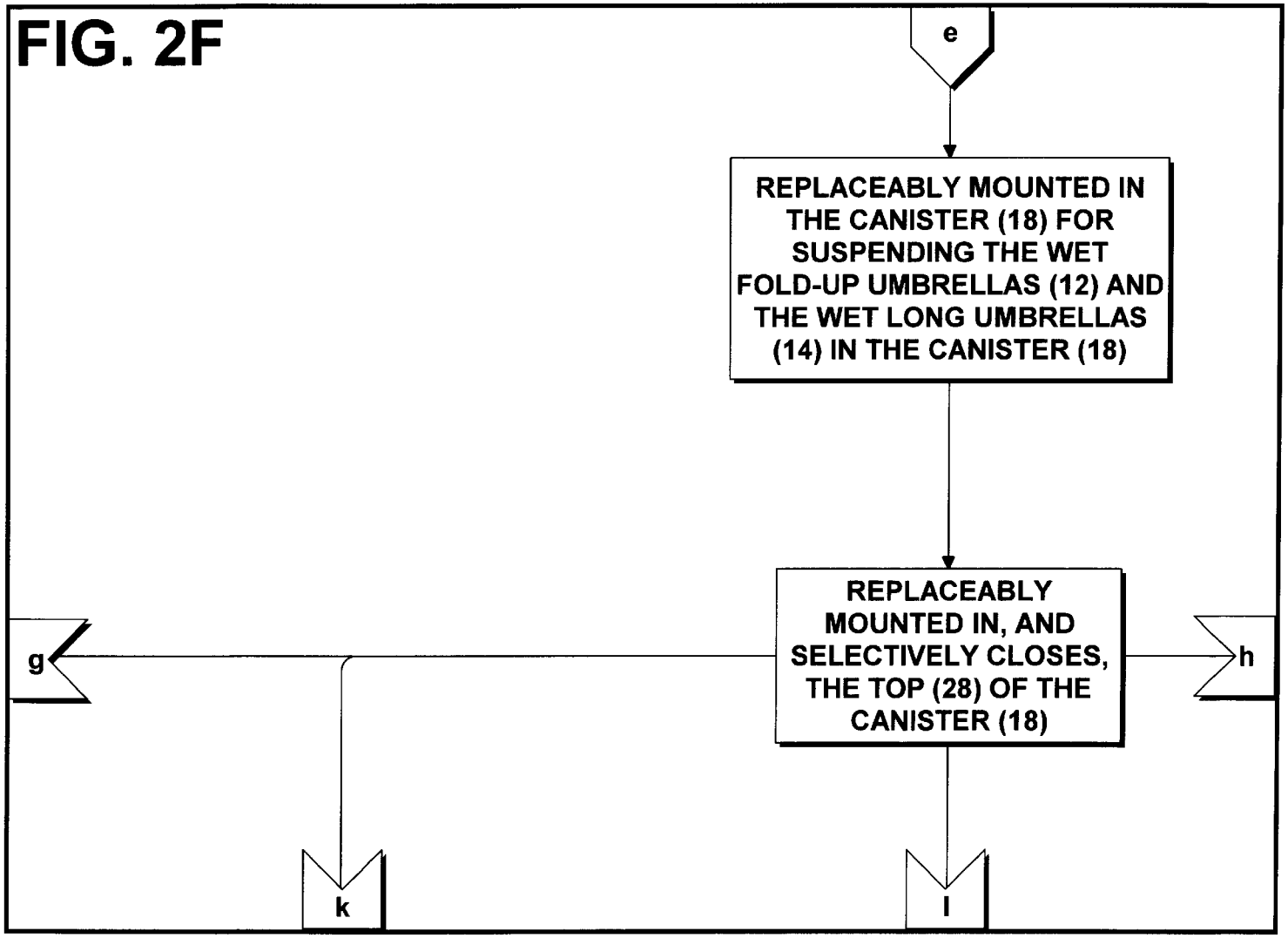
Figure 2G:
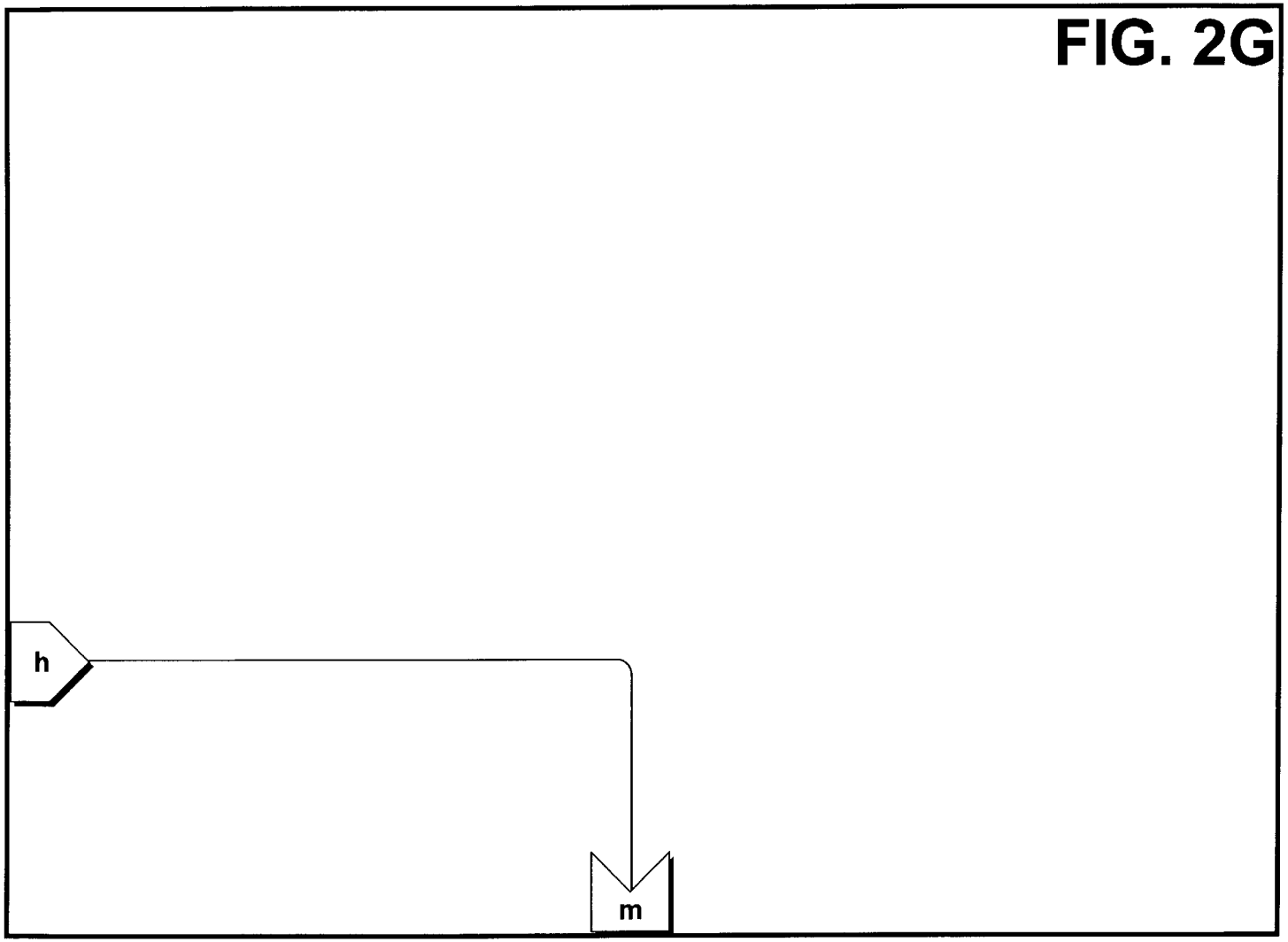
Figure 2H:
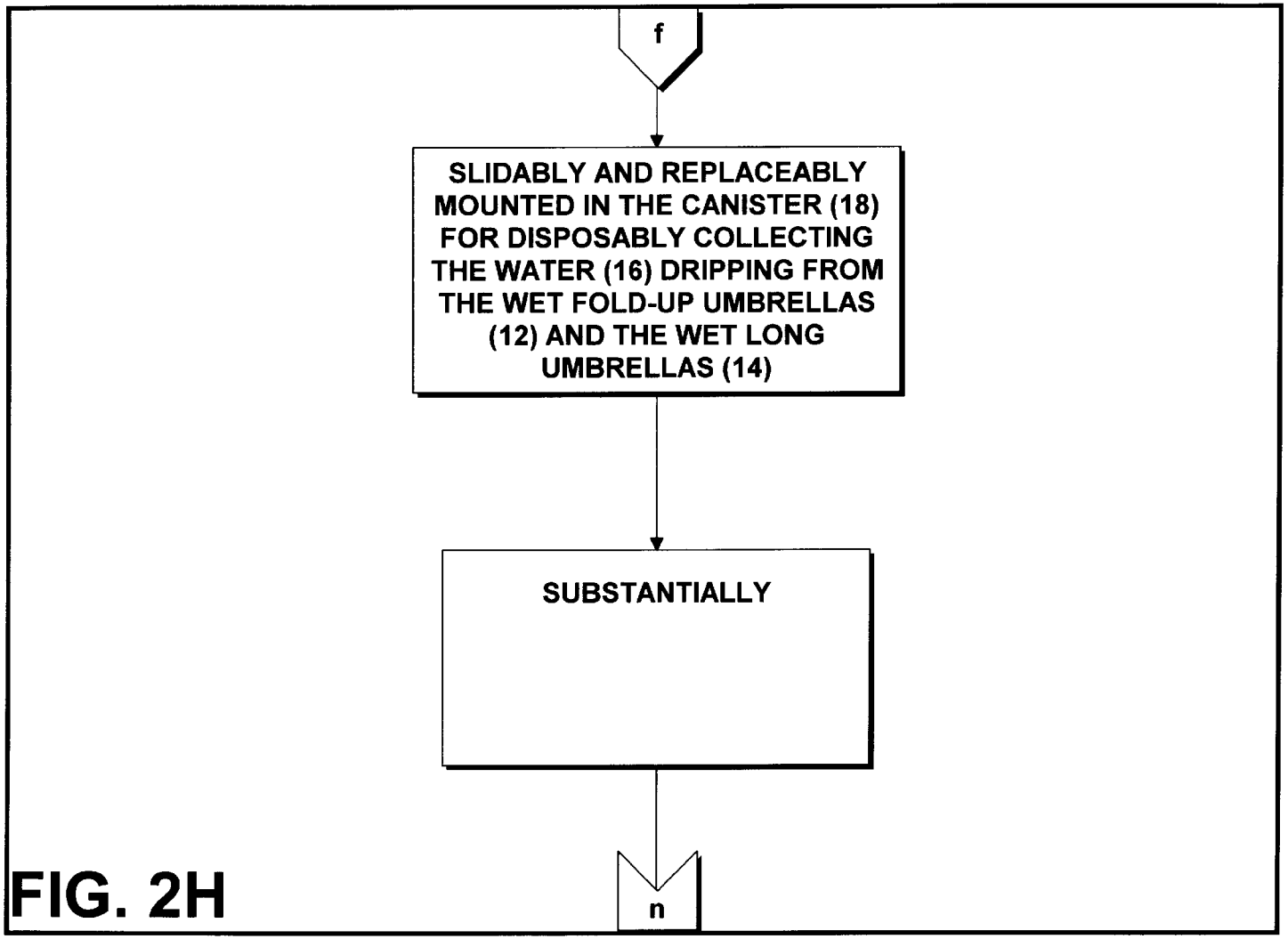
Figure 2I:
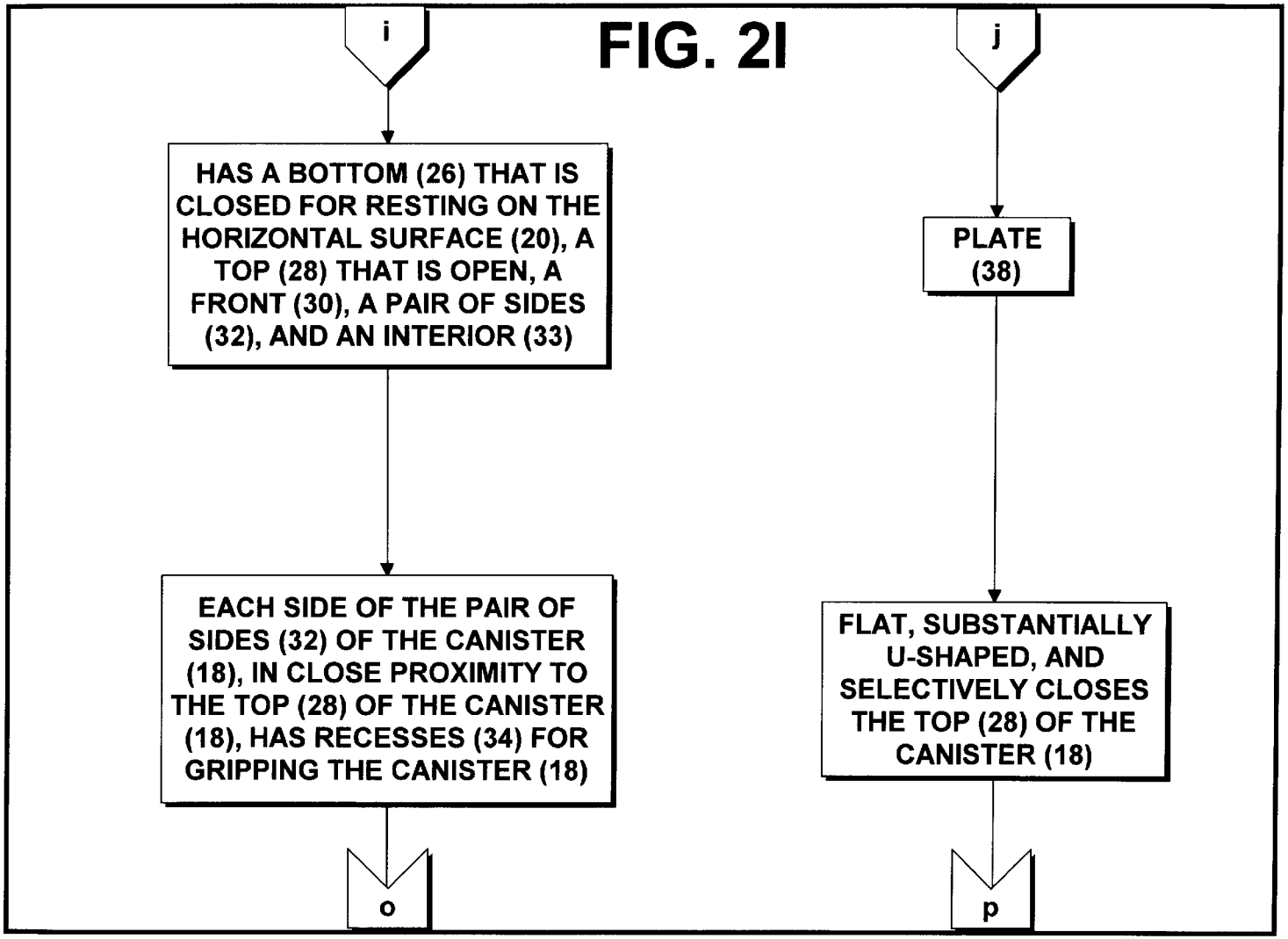
Figure 2J:
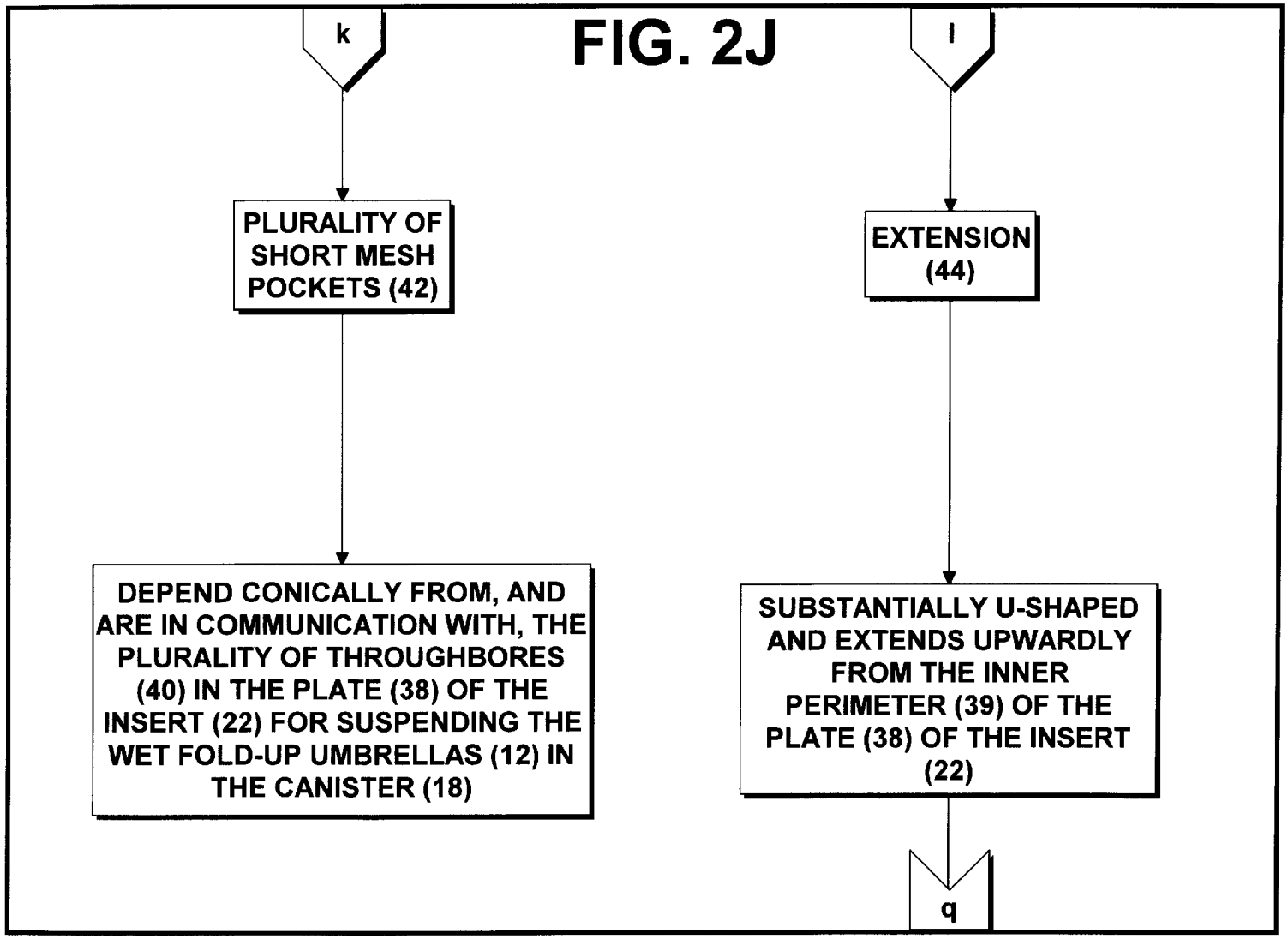
Figure 2K:
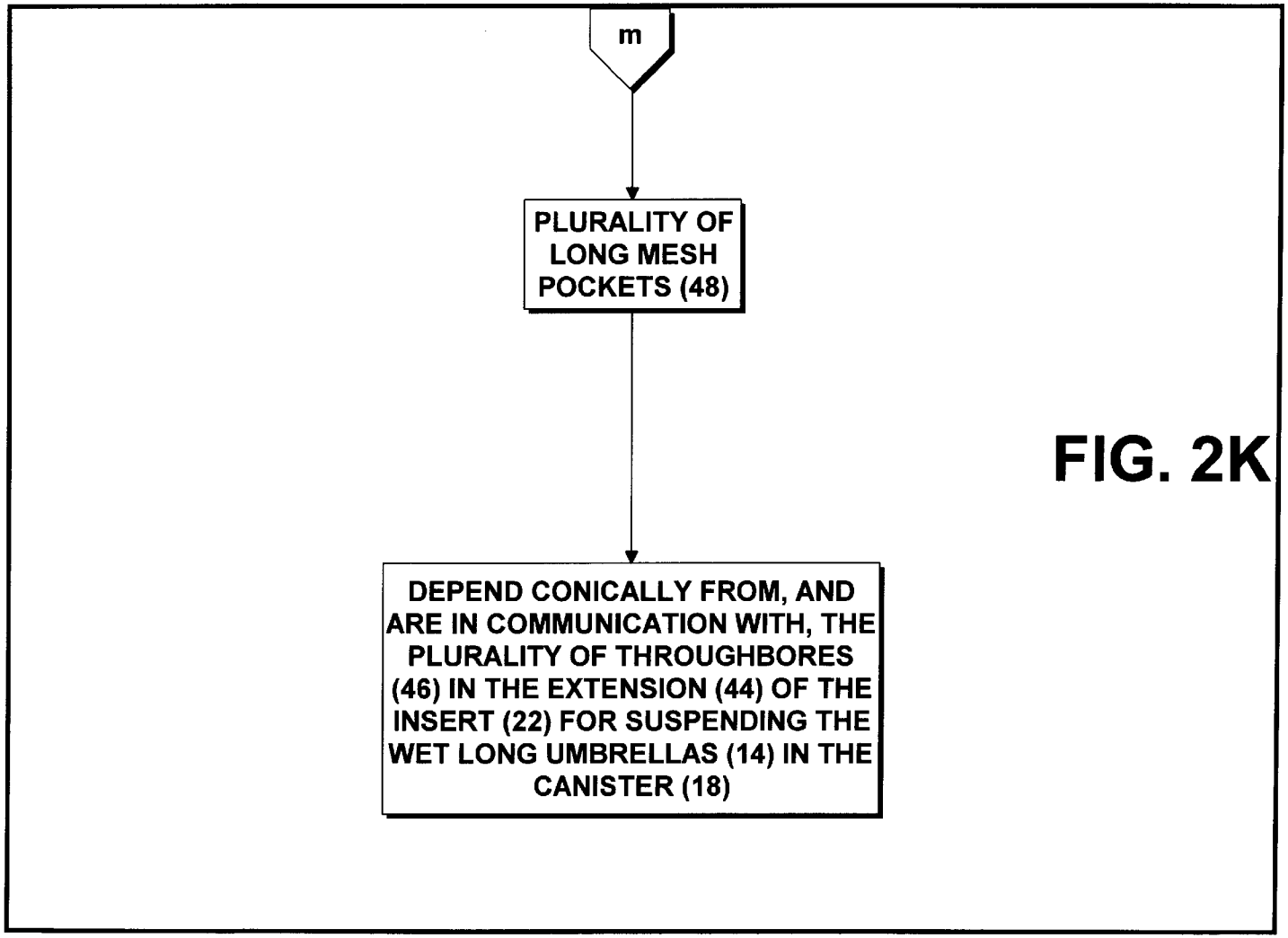
Figure 2L:
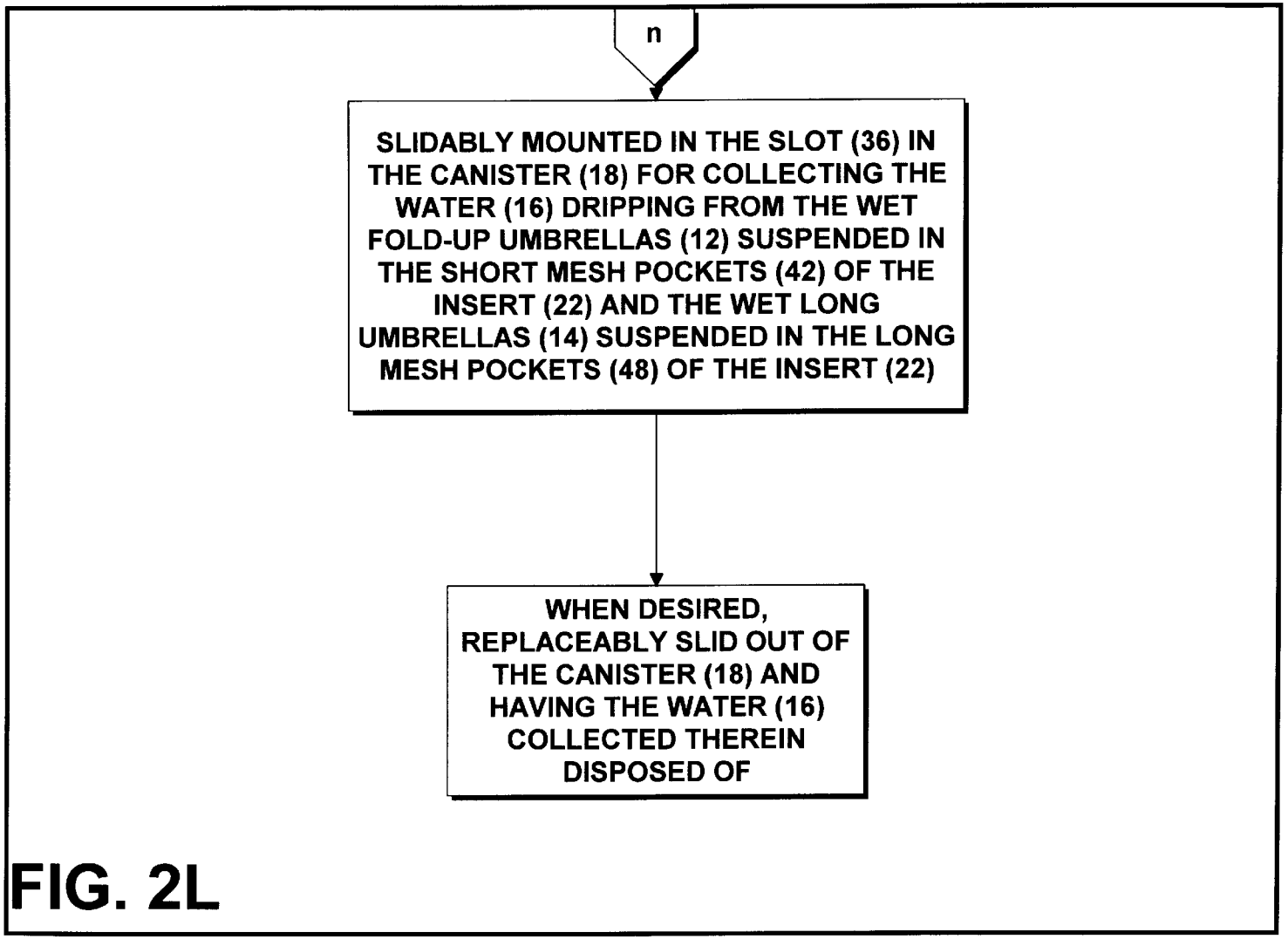
Figure 2M:
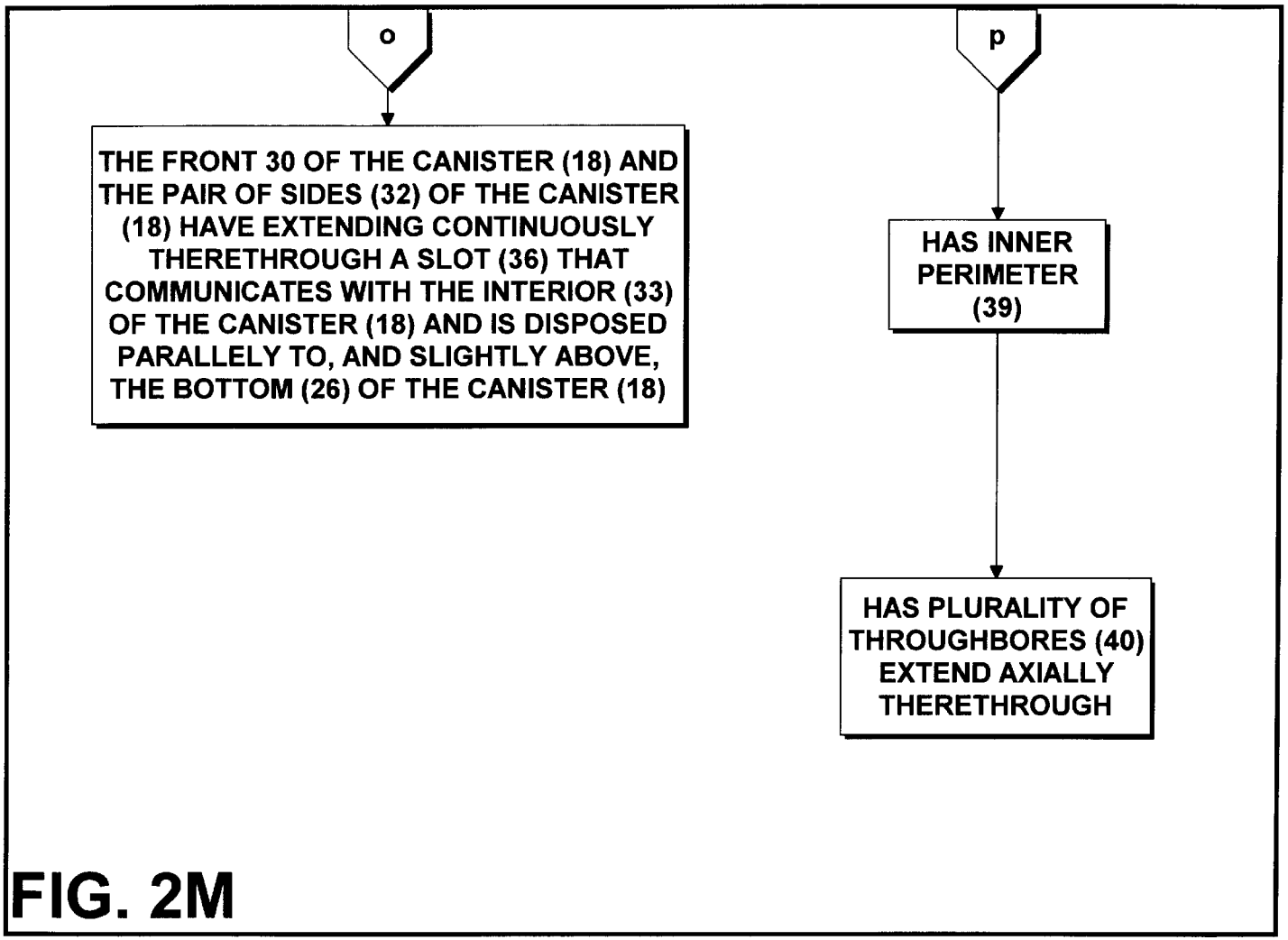
Figure 2N:
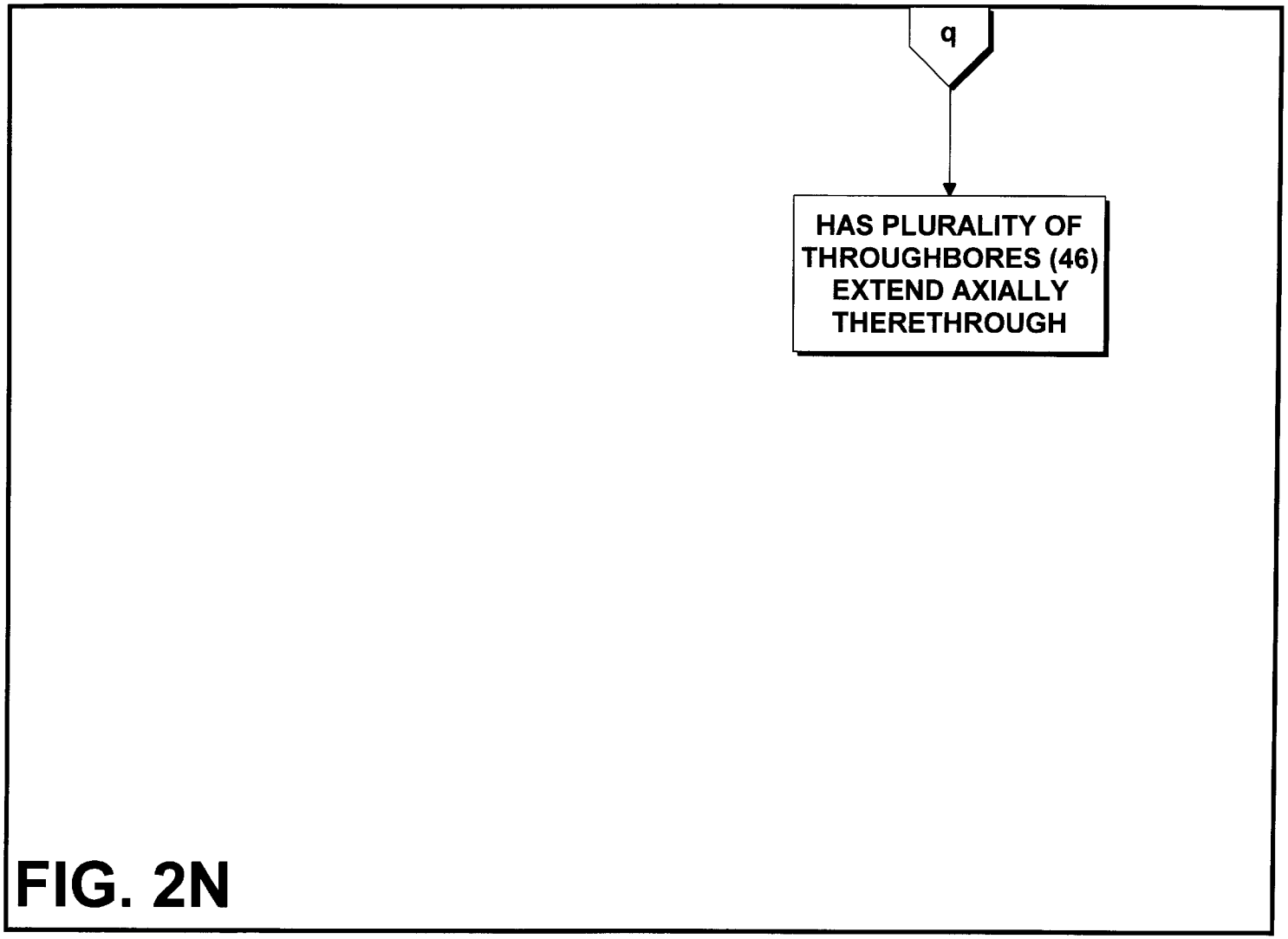

The configuration of the holder for wet fold-up and long umbrellas and for disposably collecting water dripping therefrom 10 can best be seen in FIGS. 1 and 2A–2N, which are an exploded diagrammatic perspective view of the present invention holding a plurality of wet fold-up and long umbrellas and disposably collecting water therefrom, and a system diagram of the present invention, and as such, will be discussed with reference thereto.

The holder for wet fold-up and long umbrellas and for disposably collecting water dripping therefrom 10 comprises a canister 18 for resting on a horizontal surface 20.

The canister 18 is oriented upright, is hollow, and substantially semi-cylindrically-shaped.

The canister 18 has a bottom 26 that is closed for resting on the horizontal surface 20, a top 28 that is open, a front 30, a pair of sides 32, and an interior 33.

Each side of the pair of sides 32 of the canister 18, in close proximity to the top 28 of the canister 18, has recesses 34 for gripping the canister 18.

The front 30 of the canister 18 and the pair of sides 32 of the canister 18 have extending continuously therethrough a slot 36 that communicates with the interior 33 of the canister 18 and is disposed parallely to, and slightly above, the bottom 26 of the canister 18.

The holder for wet fold-up and long umbrellas and for disposably collecting water dripping therefrom 10 further comprises an insert 22 replaceably mounted in the canister 18 for suspending the wet fold-up umbrellas 12 and the wet long umbrellas 14 in the canister 18.

The insert 22 is replaceably mounted in, and selectively closes, the top 28 of the canister 18.

The insert 22 comprises a plate 38 that is flat, substantially U-shaped, and selectively closes the top 28 of the canister 18.

The plate 38 of the insert 22 has an inner perimeter 39 and a plurality of throughbores 40 that extend axially therethrough for receiving the wet fold-up umbrellas 12.

The insert 22 further comprises a plurality of short mesh pockets 42 that depend conically from, and are in communication with, the plurality of throughbores 40 in the plate 38 of the insert 22, respectively, for suspending the wet fold-up umbrellas 12 in the canister 18.

The insert 22 further comprises an extension 44 that is substantially U-shaped and extends upwardly from the inner perimeter 39 of the plate 38 of the insert 22.

The extension 44 of the insert 22 has a plurality of throughbores 46 that extend axially therethrough for receiving the wet ling umbrellas 14.

The insert 22 further comprises a plurality of long mesh pockets 48 that depend conically from, and are in communication with, the plurality of throughbores 46 in the extension 44 of the insert 22, respectively, for suspending the wet long umbrellas 14 in the canister 18.

The holder for wet fold-up and long umbrellas and for disposably collecting water dripping therefrom 10 further comprises a drawer 24 that is slidably and replaceably mounted in the canister 18 for disposably collecting the water 16 dripping from the wet fold-up umbrellas 12 and the wet long umbrellas 14.

The drawer 24 is substantially semi-cylindrically-shaped and is slidably mounted in the slot 36 in the canister 18 for collecting the water 16 dripping from the wet fold-up umbrellas 12 suspended in the short mesh pockets 42 of the insert 22 and the wet long umbrellas 14 suspended in the long mesh pockets 48 of the insert 22, and when desired, replaceably slid out of the canister 18 and having the water 16 collected therein disposed of.

It will be understood that each of the elements described above, or two or more together, may also find a useful application in other types of constructions differing from the types described above.

While the invention has been illustrated and described as embodied in a holder for wet umbrellas and for disposably collecting water therefrom, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A holder for wet fold-up umbrellas and wet long umbrellas and for disposably collecting water dripping therefrom, said holder comprising:

a) a canister for resting on a horizontal surface;

b) an insert replaceably mounted in said canister for suspending the wet fold-up umbrellas and the wet long umbrellas in said canister; and c) a drawer slidably and replaceably mounted in said canister for disposably collecting the water dripping from the wet fold-up umbrellas and the wet long umbrellas.

2. The holder as defined in claim 1, wherein said canister is oriented upright, is hollow, and substantially semi-cylindrically-shaped.

3. The holder as defined in claim 1, wherein said canister has:

a) a bottom that is closed for resting on the horizontal surface;

b) top that is open;

c) a front;

d) a pair of sides; and e) an interior.

4. The holder as defined in claim 3, wherein each side of said pair of sides of said canister, in close proximity to said top of said canister, has recesses for gripping said canister.

5. The holder as defined in claim 3, wherein said front of said canister and said pair of sides of said canister have extending continuously therethrough a slot that communicates with said interior of said canister and is disposed parallely to, and slightly above, said bottom of said canister.

6. The holder as defined in claim 3, wherein said insert is replaceably mounted in, and selectively closes, said top of said canister.

7. The holder as defined in claim 5, wherein said insert comprises a plate that is flat, substantially U-shaped, and selectively closes said top of said canister.

8. The holder as defined in claim 7, wherein said plate of said insert has:

a) an inner perimeter; and b) a plurality of throughbores that extend axially therethrough for receiving the wet fold-up umbrellas.

9. The holder as defined in claim 8, wherein said insert further comprises a plurality of short mesh pockets that depend conically from, and are in communication with, said plurality of throughbores in said plate of said insert, respectively, for suspending the wet fold-up umbrellas in said canister.

10. The holder as defined in claim 9, wherein said insert further comprises an extension that is substantially U-shaped and extends upwardly from said inner perimeter of said plate of said insert.

11. The holder as defined in claim 10, wherein said extension of said insert has a plurality of throughbores that extend axially therethrough for receiving the wet long umbrellas.

12. The holder as defined in claim 11, wherein said insert further comprises a plurality of long mesh pockets that depend conically from, and are in communication with, said plurality of throughbores in said extension of said insert, respectively, for suspending the wet long umbrellas in said canister.

13. The holder as defined in claim 12, wherein said drawer is substantially semi-cylindrically-shaped and is slidably mounted in said slot in said canister for collecting the water dripping from the wet fold-up umbrellas suspended in said short mesh pockets of said insert and the wet long umbrellas suspended in said long mesh pockets of said insert, and when desired, replaceably slid out of said canister and having the water collected the disposed of.

* * * * *